US008628429B2

(12) United States Patent
Karcher

(10) Patent No.: US 8,628,429 B2
(45) Date of Patent: Jan. 14, 2014

(54) GOLF CLUB STAND ASSEMBLY

(76) Inventor: Richard L. Karcher, Hollidaysburg, PA (US)

( * ) Notice: Subject to any disclaimer, the term of this patent is extended or adjusted under 35 U.S.C. 154(b) by 0 days.

(21) Appl. No.: 13/295,045

(22) Filed: Nov. 12, 2011

(65) Prior Publication Data

US 2013/0123037 A1 May 16, 2013

(51) Int. Cl.
*A63B 53/00* (2006.01)

(52) U.S. Cl.
USPC ..... 473/282

(58) Field of Classification Search
USPC ..... 473/282
See application file for complete search history.

(56) References Cited

U.S. PATENT DOCUMENTS 4,462,595 A * 7/1984 Hodson ..... 473/243

* cited by examiner

*Primary Examiner* — Michael Dennis
(74) *Attorney, Agent, or Firm* — Novak Druce Connolly Bove + Quigg *LLP*

(57) ABSTRACT

A stand assembly for a golf club having a club head and club shaft may include a plunger rod movably secured within the club shaft and club head and displaceable between a retracted position entirely within the club head and an extended position. In the extended position, at least a portion of the plunger rod is extended through a channel in the club head to an exterior of the golf club. The stand assembly may further include an actuation sleeve configured to be disposed about the club shaft and a connecting member extending through a wall of the club shaft and coupling the actuation sleeve with the plunger rod. The actuation sleeve may be selectively actuable to secure the plunger rod in both the retracted position and the extended position.

2 Claims, 4 Drawing Sheets

GOLF CLUB STAND ASSEMBLY

TECHNICAL FIELD

The present disclosure relates to a stand assembly for a golf club and, more particularly, to a retractable plunger rod in the golf club shaft insertable into the ground for supporting a golf club in a standing position.

BACKGROUND

When playing golf, golfers are not typically permitted to drive golf carts near a putting green. Walking golfers are not permitted to lay or stand their golf bags on a putting green. Further, golfers are frequently required to keep golf carts on cart paths during various weather conditions. Thus, in order to expedite play by avoiding multiple trips back-and-forth to one's golf bag, it is quite common for a golfer to remove multiple clubs from a golf bag for executing a next stroke or series of strokes. For example, if a golfer's ball is close but not quite on the putting surface, the golfer may carry to the putting surface area a chipping club such as a wedge or the like for getting the ball on the putting surface and a putter to complete the hole after the ball is on the putting surface. As another example, if a golfer is not sure of his lie from the location of his/her golf bag, the golfer may carry a variety of clubs to the ball location before making a final club selection. For an average golfer, this is a regular occurrence during a course of a round.

Since the golfer is carrying multiple clubs, when it is time to execute the next stroke, the golfer typically places the unused club(s) on the ground. There are drawbacks to this situation particularly if the ground is wet from morning dew or rain or if the player has difficulty bending over to pick up the club or clubs on the ground. It is desirable to maintain dry club grips to avoid slipping and to prevent damage to the grip. Additionally, golfers with joint or back problems or the like may find it difficult or uncomfortable to repeatedly retrieve a golf club(s) from the ground.

Several others have disclosed a stand assembly for a golf club that can enable the golf club to stand in an upright position when not in use. For example, U.S. Pat. No. 4,462,595 (Hodson) and U.S. Patent Application Publication No. 2010/0137070 (Horne) disclose assemblies for standing a golf club in an upright position. However, Hodson provides an actuation assembly in the middle of the club's grip. Since a golfer's grip is one of the most important elements of a golf stroke, it is undesirable to provide an actuation assembly that affects the grip. Horne provides an actuation assembly that extends from the grip end of the club when unactuated and is urged into the grip when actuated. Thus, since golf clubs are typically stored in a golf bag by placing the grip end into the bag, the prop rod spike may be undesirably exposed from the club head each time the club is placed into the bag, thus presenting a dangerous situation.

It may therefore be desirable for such a device to be incorporated into the club itself and to be easily extractable and retractable without affecting the grip and/or functionality of the club. It may also be desirable to provide such a device that minimizes the effect on the club's aesthetics.

SUMMARY

According to various aspects of the disclosure, a stand assembly for a golf club having a club head and club shaft may include a plunger rod movably secured within the club shaft and club head and displaceable between a retracted position entirely within the club head and an extended position. In the extended position, at least a portion of the plunger rod is extended through a channel in the club head to an exterior of the golf club. The stand assembly may further include an actuation sleeve configured to be disposed about the club shaft and a connecting member extending through a wall of the club shaft and coupling the actuation sleeve with the plunger rod. The actuation sleeve may be selectively actuable to secure the plunger rod in both the retracted position and the extended position.

In accordance with various aspects of the disclosure, a golf club may include a club head adapted to strike a golf ball and a club shaft extending upwardly from the club head and having a gripping portion adapted to be gripped by the golfer. The head portion has an open-ended bore therethrough, and the club shaft is tubular and continuously hollow from the club head to and into the gripping portion of the club. The bore of the club head is axially aligned with the tubular club shaft. The golf club may include a plunger rod movably secured within the club shaft and club head and displaceable between a retracted position entirely within the club head and an extended position. In the extended position, at least a portion of the plunger rod is extended through a channel in the club head to an exterior of the golf club. The golf club may further include an actuation sleeve configured to be disposed about the club shaft and a connecting member extending through a wall of the club shaft and coupling the actuation sleeve with the plunger rod. The actuation sleeve may be selectively actuable to secure the plunger rod in both the retracted position and the extended position.

Further exemplary embodiments and advantages may be evident from the accompanying drawings.

DETAILED DESCRIPTION

Figure 1:
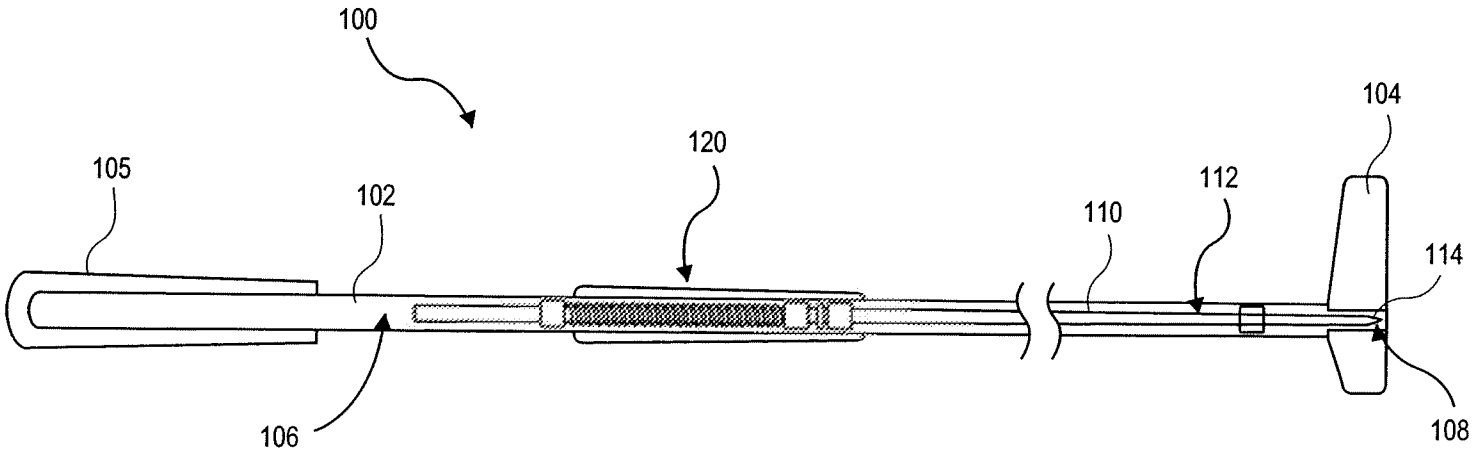
FIG. 1 is a cutaway side view of an exemplary stand assembly with the plunger rod in a retracted position in accordance with various aspects of the disclosure.
Figure 2:
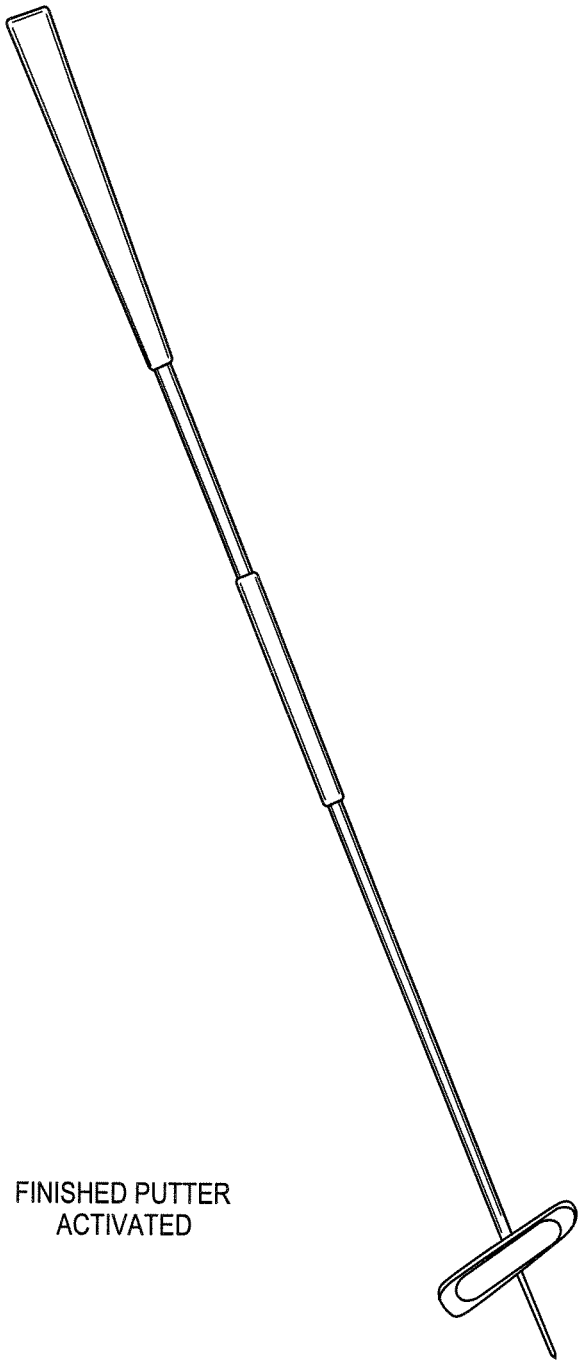
FIG. 2 is a perspective view of the stand assembly shown in FIG. 1 with the plunger rod in an extended position.

FIGS. 1 and 2 are cross sectional views of an exemplary golf club stand assembly in accordance with various aspects of the disclosure. As shown in FIGS. 1 and 2, the stand assembly 100 is integrated with the golf club via a club shaft 102 and a club head 104 secured to the club shaft 102. A golf club can be provided with the stand assembly 100 upon manufacture and assembly, or a conventional golf club can be retrofitted with the stand assembly 100. The shaft 102 is typically hollow, and a channel 106 is formed in the club head 104, which together with the hollow club shaft 102 defines a rod channel 108.

The stand assembly 100 includes a plunger rod 110 positionable within the club shaft 102 and club head 104 and displaceable between a retracted position (FIG. 1), in which the plunger rod 110 is preferably disposed completely within the golf club, and an extended position (FIG. 2), in which at least a first end portion 112 of the plunger rod 110 is extended to an exterior of the golf club. The plunger rod 110 may comprise, for example, titanium or any other material that provides the desired strength, stiffness, durability, and other properties (e.g., rust-proof). The first end portion 112 of the plunger rod 110 may include a tapered or pointed end 114 so as to facilitate insertion into the ground when in the extended position. The stand assembly 100 also includes an actuation assembly 120 coupled with the plunger rod 110 and operable to move the plunger rod 110 between the retracted position and the extended position. The actuation assembly is between a grip portion 105 of the golf club and the club head 104.

Figure 3:
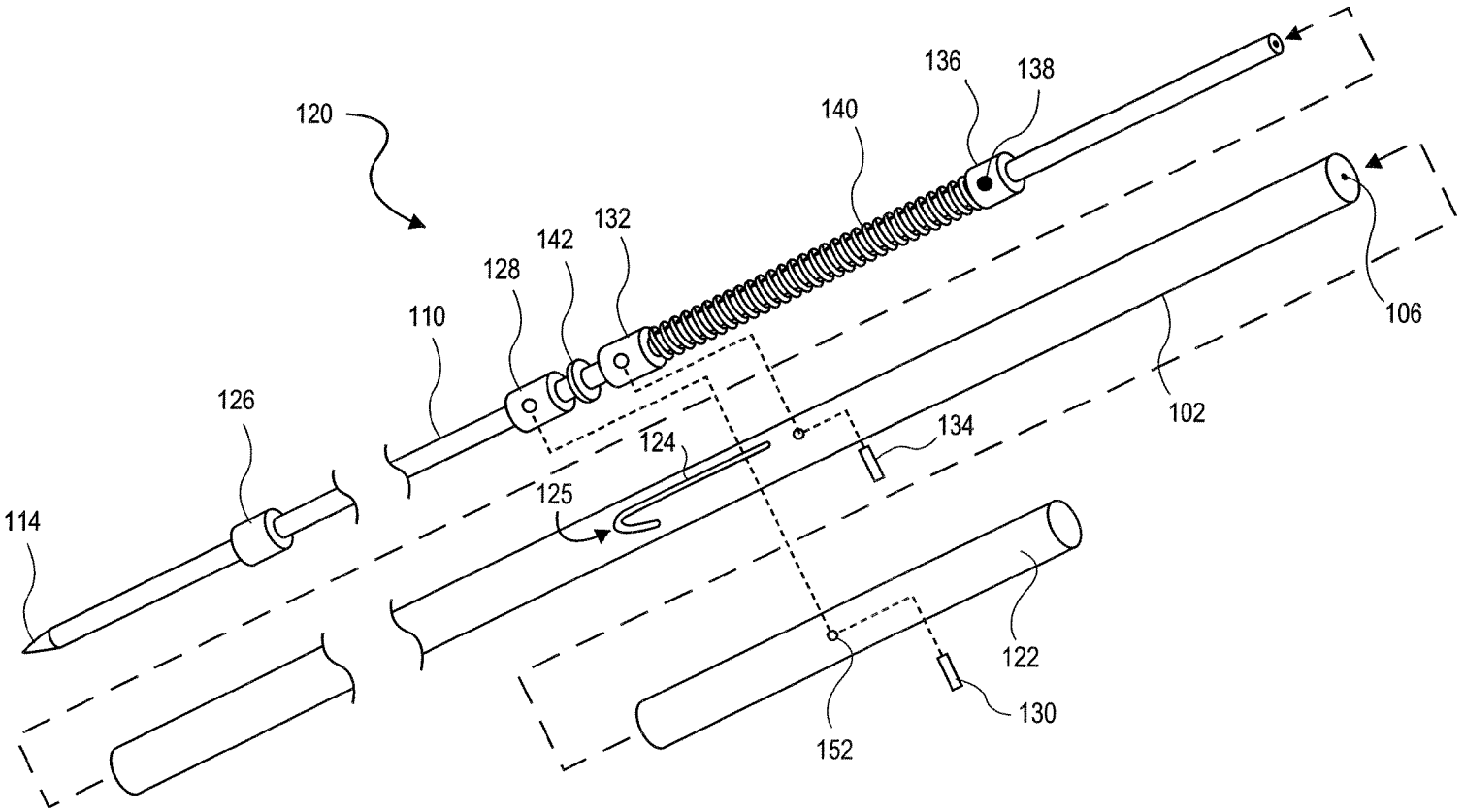
FIG. 3 is an exploded view of an exemplary actuation assembly of the stand assembly of FIGS. 1 and 2.

FIG. 3 shows an exploded view of the actuation assembly 120 in accordance with aspects of the disclosure. Referring to FIGS. 1-3, the actuation assembly 120 includes an actuation sleeve 122 disposed about the club shaft 102. The sleeve is slidable and rotatable relative to the club shaft 102 to move the plunger rod 110 between and to secure the plunger rod 110 in the retracted position or the extended position. Movement of the actuation sleeve 122 is guided and restricted by a slot 124, for example, a J-slot, in the club shaft 102, as will be more fully described below. The actuation sleeve 122 may additionally include a vibration dampener (not shown) at the end of the sleeve 122 nearest the first end portion 112. The vibration dampener is positioned about the club shaft 102 and inside the sleeve 122 to prevent the sleeve 122 from rattling on the club shaft in the retracted and extended positions. The vibration dampener may comprise, for example, a rubber washer.

Proximal to the first end portion 112 of the plunger rod 110, the actuation assembly includes a first ring 126 about the rod 110 and internal to the club shaft 102. The first ring 126 is fixedly coupled to the club shaft 102, for example, by adhering the first ring 126 to an inside surface of the shaft 102, for example, with an epoxy. The plunger rod 110 is slidable relative to the first ring 126. Spaced from the first ring 126 in a direction away from the first end portion 112 of the plunger rod 110 is a second ring 128 about the rod 110 and internal to the club shaft 102. The second ring 128 is affixed to the plunger rod 110 and the actuation sleeve 122 by a connecting member 130 extending through the J-slot 124 and through a hole 131 in the second ring 128 and into the second ring 128. Thus, movement of the actuation sleeve 122 moves the second ring 128 and the plunger rod 110 in a likewise fashion.

Spaced from the second ring 128 in a direction away from the first end portion 112 of the plunger rod 110 is a third ring 132 about the rod 110 and internal to the club shaft 102. The third ring 132 is fixedly coupled to the club shaft 102, for example, by a pin 134 that extends through a hole 135 in the club shaft 102 and into a hole 133 in the third ring 132. Thus, the plunger rod 110 is slidable relative to the third ring 132. Spaced from the third ring 132 in a direction away from the first end portion 112 of the plunger rod 110 is a fourth ring 136 about the rod 110 and internal to the club shaft 102. The fourth ring 136 is affixed to the plunger rod 110 by a pin 138 extending through a hole in the fourth ring 136 and into the plunger rod 110. Thus, movement of the plunger rod 110 moves the fourth ring 136 in a likewise fashion.

The actuation assembly 120 includes a spring 140, for example, a helical compression spring, about the plunger rod 110 and internal to the club shaft 102. The spring 140 is disposed between the third ring 132 and the fourth ring 136. In the retracted position of the plunger rod 110 (FIG. 1), the spring 140 is under nominal compression, for example, sufficient compression such that the spring 140 is substantially stationary. The actuation assembly 120 may further include dampening member 142 such as, for example, an O-ring, disposed between the second ring 128 and the third ring 132. According to various aspects, the dampening member 142 may fit snugly about the plunger rod 110 so as not to slide freely thereon. The dampening member 132 may be placed tightly against the second ring 128 so as to cushion impact by the third ring 132. The O-ring may comprise, for example, a rubber material. The first, second, third, and fourth rings 126, 128, 132, 136 may comprise, for example, aluminium.

Figure 4:
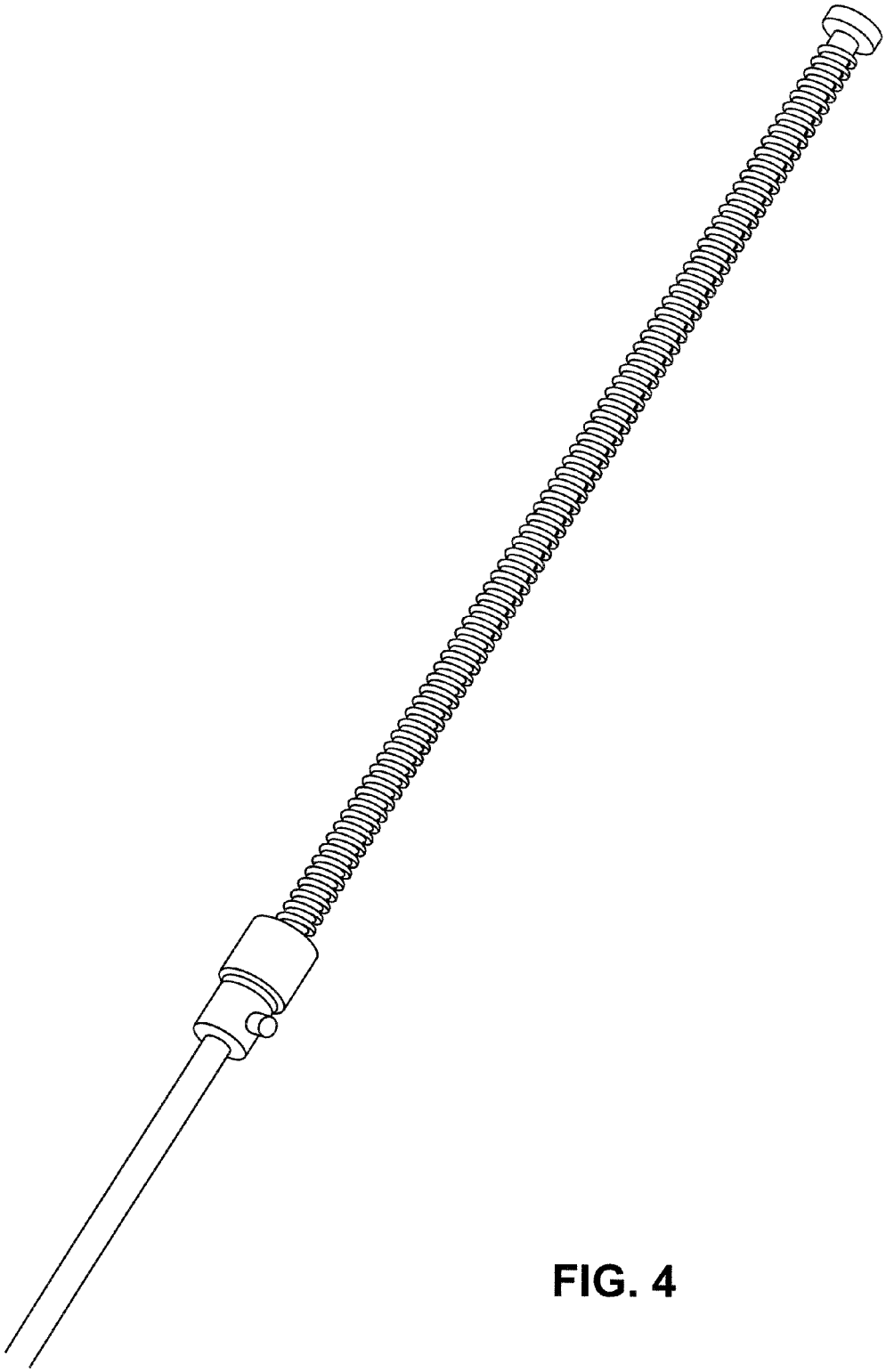
FIG. 4 is a perspective view of a portion of the actuation assembly shown in FIG. 3.

Referring now to FIG. 4, in some aspects, the second ring 128 may include a guide 150 affixed to a side of the second ring 128 and plunger rod 110 facing the J-slot 124. The guide 150 includes a first portion 154 nearest the second ring 128 in a radial direction. The first portion 154 is sized and arranged so as to fit within the J-slot 124. For example, the thickness of the first portion 154 both radially and tangentially to the radial direction is selected to fit within the J-slot 124 so as to be guided in motion by the J-slot 124. The guide 150 may also include a second portion 156 disposed radially outward relative to the first portion 154. As shown, the second portion 156 is enlarged relative to the first portion 154 in a dimension tangential to the radial direction. As such, when the plunger rod 110, club shaft 102, and sleeve 122 are assembly, the second portion 156 is disposed radially outward of the club shaft 102 (e.g., between the club shaft 102 and the sleeve 122), and the first portion 154 extends through the J-slot 124 in the club shaft 102 and is affixed, for example, by welding to the second ring 128 and plunger rod 110. A connecting member 130, such as for example, a pin or a screw, may extend through a hole 152 in the sleeve 122 and into a hole 158 in the guide 150 to couple the sleeve 122 to the guide 150 and plunger rod 110.

As shown in FIGS. 1 and 2, the channel 106 formed in the club head 104 is narrower than an inside diameter of the club shaft 102. Preferably, the channel 106 is only slightly larger than a width or diameter of the plunger rod 110. The assembly may include additional internal components to increase the stability of the plunger rod and to accommodate varying club shaft internal diameters. For example, a sleeve or piece of tubing may be interposed between the plunger rod and the club shaft to effectively narrow the internal diameter of the club shaft relative to the plunger rod. In this manner, the plunger rod can better maintain a vertical attitude relative to the club shaft and avoid getting caught up in the rod channel. These components may help to keep the plunger rod centered in the rod channel.

In use, when it is desired to extend the plunger rod 110 from the retracted position to the extended position, the user slides the actuation sleeve 122 along the J-slot 124 as far as possible in the direction of the club head 104. This sliding of the actuation sleeve 122 causes the fourth ring 136 to further compress the spring 140 against the fixed third ring 132. After reaching the end 125 of the J-slot 124 closest to the club head 104, the user rotates the actuation sleeve 122 in a first direction, for example, counter-clockwise, as guided by the J-slot 124, and then releases the actuation sleeve 122, thereby allowing the spring 140 to urge the fourth ring 136 away from the third ring 132. The tension of the spring 140 then maintains the plunger rod 110 in the extended position, as shown in FIG. 2.

To retract the extended plunger rod 110, the user slides the actuation sleeve 122 as far as possible in the direction of the club head 104 and, after reaching the end 125 of the J-slot 124 closest to the club head 104, the user rotates the actuation sleeve 122 in a second direction opposite to the first direction, for example, clockwise, as guided by the J-slot 124. The user then releases the actuation sleeve 122, thereby allowing the spring 140 to urge the fourth ring 136 away from the third ring 132. The tension of the spring 140 then returns the plunger rod 110 to the retracted position, as shown in FIG. 1.

With the integrated stand assembly according to the described embodiments, a golf club can stand in an upright position when not in use. Additionally, the stand mechanism is easily extendable and retractable without affecting the grip and functionality of the club. Further, the stand assembly only minimally alters the club's aesthetics.

It will be apparent to those skilled in the art that various modifications and variations can be made to the golf club stand assembly and method of the present disclosure without departing from the scope of the invention. Throughout the disclosure, use of the terms "a," "an," and "the" may include one or more of the elements to which they refer. Other embodiments of the invention will be apparent to those skilled in the art from consideration of the specification and practice of the invention disclosed herein. It is intended that the specification and examples be considered as exemplary only.

The invention claimed is:

1. A stand assembly for a golf club including a club shaft and a club head, the stand assembly comprising:

a plunger rod movably secured within the club shaft and club head and displaceable between a retracted position entirely within the club head and an extended position, wherein in the extended position, at least a portion of the plunger rod is extended through a channel in the club head to an exterior of the golf club;

an actuation sleeve extending around a periphery of the club shaft; and a connecting member extending through a wall of the club shaft and coupling the actuation sleeve with the plunger rod, the actuation sleeve being selectively actuable to secure the plunger rod in both the retracted position and the extended position.

2. A golf club, comprising:

a club head adapted to strike a golf ball, the head portion having an open-ended bore therethrough;

a club shaft extending upwardly from the club head and having a gripping portion adapted to be gripped by the golfer, the club shaft being tubular and continuously hollow from the club head to and into the gripping portion of the club, the bore of the club head being axially aligned with the tubular club shaft;

a plunger rod movably secured within the club shaft and club head and displaceable between a retracted position entirely within the club head and an extended position, wherein in the extended position, at least a portion of the plunger rod is extended through a channel in the club head to an exterior of the golf club;

an actuation sleeve extending around a periphery of the club shaft; and a connecting member extending through a wall of the club shaft and coupling the actuation sleeve with the plunger rod, the actuation sleeve being selectively actuable to secure the plunger rod in both the retracted position and the extended position.

* * * * *